US006911099B2

(12) United States Patent
Magnusen et al.

(10) Patent No.: US 6,911,099 B2
(45) Date of Patent: Jun. 28, 2005

(54) PROCESS TO IMPROVE 6XXX ALLOYS BY REDUCING ALTERED DENSITY SITES

(75) Inventors: Paul E. Magnusen, Pittsburgh, PA (US); Dhruba J. Chakrabarti, Export, PA (US); Anne E. Zemo, Riverdale, IA (US); Robert W. Westerlund, Bettendorf, IA (US); Anthony Morales, Bettendorf, IA (US); Daniel T. Moulton, Bettendorf, IA (US)

(73) Assignee: Alcoa Inc., Pittsburgh, PA (US)

( * ) Notice: Subject to any disclaimer, the term of this patent is extended or adjusted under 35 U.S.C. 154(b) by 117 days.

(21) Appl. No.: 10/283,004

(22) Filed: Oct. 29, 2002

(65) Prior Publication Data

US 2003/0127165 A1 Jul. 10, 2003

Related U.S. Application Data

(62) Division of application No. 09/873,980, filed on Jun. 1, 2001, now Pat. No. 6,613,167.

(51) Int. Cl.[7] ..... C22C 21/08
(52) U.S. Cl. ..... 148/417; 420/534; 420/535
(58) Field of Search ..... 148/416, 417; 420/532, 534, 535

(56) References Cited

U.S. PATENT DOCUMENTS

| | | | | |
|---|---|---|---|---|
| 3,645,804 A | | 2/1972 | Ponchel | 148/128 |
| 4,019,931 A | | 4/1977 | Setzer et al. | 148/11.5 |
| 4,082,578 A | | 4/1978 | Evancho et al. | 148/12.7 |
| 4,589,932 A | | 5/1986 | Park | 148/12.7 |
| 5,213,639 A | | 5/1993 | Colvin et al. | 148/693 |
| 5,858,134 A | * | 1/1999 | Bechet et al. | 148/550 |
| 5,993,573 A | | 11/1999 | Selepack et al. | 148/551 |
| 6,537,392 B2 | * | 3/2003 | Magnusen et al. | 148/417 |

OTHER PUBLICATIONS

"International Alloy Designations and Chemical Composition Limits for Wrought Aluminum and Wrought Aluminum Alloys", Amuminum Association, 1997, p 8–9.*

* cited by examiner

*Primary Examiner*—George Wyszomierski
*Assistant Examiner*—Janelle Morillo
(74) *Attorney, Agent, or Firm*—D. Mark Meloney; Eckert Seamens Cherin & Mellott, LLC

(57) ABSTRACT

A process for improving 6XXX alloys, such as 6013, preferably includes heating, hot rolling, inter-rolling thermal treatment at a very high temperature such as 1020° F. or more, again hot rolling (with or without subsequent continuous hot rolling or cold rolling or both), solution heat treating and artificial aging. The initial heating, inter-rolling, thermal treatment and solution treatment, especially the latter two, are carried out at very high temperatures such as 1030° F. Each aforesaid hot rolling stage produces substantial metal thickness reduction. The improved sheet or plate product has a substantially reduced occurrence of reduced density features revealed in scanning electron microscope examination at 500X and exhibits improved (reduced) fatigue crack growth rate providing an advantage in aerospace applications such as fuselage skin, especially fuselage belly skin.

82 Claims, No Drawings

PROCESS TO IMPROVE 6XXX ALLOYS BY REDUCING ALTERED DENSITY SITES

CROSS-REFERENCE TO RELATED APPLICATIONS

This application is a division of U.S. application Ser. No. 09/873,980, filed Jun. 1, 2001 now U.S. Pat. No. 6,613,167.

BACKGROUND OF THE INVENTION

The present invention relates to relatively strong aluminum alloy products suitable for important applications such as airplane fuselage panels or parts and other applications and to improved methods for making such.

Heat treatable aluminum alloys are employed in many applications where high strength and low weight are desired. The 7XXX series of aluminum alloys (the Aluminum Association designates series or families of aluminum alloys by numbers as is well known) is very strong having typical yield strength (Y.S.) levels of 70 or 80 ksi or more. The term "ksi" refers to thousands of pounds per square inch; 80 ksi means 80000 pounds per square inch (psi). The 6XXX series of heat treatment aluminum alloys is not as strong as the 7XXX alloys but still has very good strength-to-weight ratio, quite good toughness and corrosion resistance, together with good weldability for many of the 6XXX alloys, in that 6XXX alloys after welding have good retention of mechanical properties, for instance, a higher percent retention in the weld zone than commonly used 2XXX or 7XXX alloys. Heat treatable alloys are solution heat treated at relatively high temperatures, quenched such as by water immersion or sprays and then artificially aged to develop their strength, as is well known. The products can be sold after quench and before artificial aging in a T4 type temper (solution heat treated, quenched and allowed to reach a stable naturally aged property level). The T4 type condition allows more ease of bending and shaping than the much stronger artificially (heat) aged T6 temper. The 6XXX series of alloys contain magnesium (Mg) and silicon (Si) as their main alloying ingredients, often also including lesser amounts of elements such as one or more of copper (Cu), manganese (Mn), chromium (Cr) or other elements. Alloy 6061 is commonly used for sheet and plate and forgings and 6063 is an old extrusion alloy in the 6XXX family. More recent alloys are 6009 and 6010 and are described in U.S. Pat. No. 4,082,578 to Evancho, and still more recent is alloy 6013 described in U.S. Pat. No. 4,589,932 to Park. The entire contents of both U.S. Pat. Nos. 4,082,578 and 4,589,932 are incorporated herein by reference. Alloy 6013 has been used in automotive and aerospace applications as well as others. It is recognized in the art as providing good strength, toughness, workability, corrosion resistance and good weldability so as to make it desirable for many uses. According to Aluminum Association limits, alloy 6013 contains aluminum and 0.6 to 1% Si; 0.8 to 1.2% Mg; 0.6 to 1.1% Cu; 0.2 to 0.8% Mn; 0.5% max. Fe; 0.1% max. Cr; 0.25% max. Zn; 0.1% max. Ti; not more than 0.05% each of other elements (0.15% total others), all percentages for aluminum alloy compositions referred to herein being by weight unless otherwise indicated. Alloy 6013 is typically produced by homogenizing at a very high temperature such as 1040° F. or so followed by hot rolling and, for thinner metal gauges, cold rolling, then solution heat treating at a high temperature such as 1040° F. or so, quenching and artificial aging.

Alloy 6013 is being thought about for use as large sheet or plate panels in very large commercial jet aircraft as fuselage panels, especially fuselage belly panels (belly panels are on the fuselage underside as is known), and possibly even larger fuselage portions such as most or even all of the fuselage. However, this potential use may be impended by a condition in 6013 sheet and plate products which appear as microscopic features under 500× magnification that look similar to pores but are not voids (pores are voids.). These features can also be found in other 6XXX alloys. These features are typically about 1 or 2 microns to about 5 or more (most being 2 to 5 $\mu$cm) microns ($\mu$m) in size referring to their major axis and can be detected by scanning electron microscopy (SEM) where they appear as microscopic "features" or pockets of reduced density in that they cause less reflection or backscattering of electrons than the surrounding metal which appears as normal density. Thus, the features might look like pores or voids at first but on more refined analysis appear as reduced or altered density features, that is, relatively solid but less dense than surrounding metal. Under SEM, the features appear as dark spots to suggest less density or at least less reflection of electrons in comparison to surrounding metal which reflects more electrons. In referring to reduced density features herein, such refers to appearance, under SEM examination preferably at an accelerating voltage of about 15 kilo-electron volts (keV or kV for short in SEM nomenclature) where the features are readily seen. (At 5 keV, the features are more difficult to see). The magnifications employed can vary from 500× to 10,000× although 500×is quite useful. Backscattered electron imaging is used rather than secondary electron imaging so as to provide higher contrast between the features and surrounding metal. These SEM techniques are all well known in the SEM art. Under SEM examination using backscattered electron imaging, a higher density site (such as one having elements of high atomic weight) reflects more electrons (looks lighter) than a lower density site, such as the reduced density features here described, which appear as darker spots. Magnesium silicide particles ($Mg_2Si$) also can appear as dark spots under SEM because magnesium's atomic weight is lower than aluminum's but can be distinguished from the aforesaid reduced density sites by examining the X-rays emitted from the sample in the SEM using standard energy dispersive X-ray spectroscopy methods which are well known in the art. The reduced density features' composition differs quite substantially from $Mg_2Si$ in X-ray spectroscopy and is much more like the surrounding material composition albeit at lower density. In commercially produced 6013-T6, these features typically can number from around 50,000 or so to over 125,000 features or bodies in a square inch under 500× magnification in a metallographicly polished sample suitable for SEM. The sample can be taken at or near the mid-thickness plane but such is not necessary.

It is believed that these features apparently might act as weak spots during propagation of a crack such as in a fracture toughness test or more likely in a fatigue crack growth rate test or otherwise act adversely and it is considered very desirable to eliminate or reduce these features or defects. Thus, while 6013 type alloy sheet and plate are good products, they could be significantly improved by eliminating these features and thereby improving properties, especially by reducing fatigue crack growth rate.

SUMMARY OF THE INVENTION

According to the invention, the 6XXX alloy product is made by operations including heating to a preferably high temperature, hot rolling, thermally treating that rolled metal at a high temperature, preferably 1020° F. or more, again hot rolling, cold rolling (if desired), solution heat treating, preferably at 1020° F. or more, quenching and then artificial aging. A shaping operation such as bending or stretch forming can be used between quenching and artificial aging. The improved products made by such method exhibit substantial freedom or at least greatly reduced amounts of the undesired reduced density features and substantially improved (i.e., reduced) fatigue crack growth rate.

DETAILED DESCRIPTION OF PREFERRED EMBODIMENTS

The invention is especially suited to 6013, a preferred alloy, and similar alloys. Alloy 6013 for purposes of this invention consists essentially of 0.8–1.2% Mg; 0.6–1% Si; 0.6–1.1% Cu; 0.20–0.8% Mn; balance essentially aluminum and incidental elements and impurities. One preferred embodiment of the invention includes 6013 type alloys, or alloys similar thereto except for Mn content such as consisting essentially of about 0.5 to 1.3% Si, 0.6to 1.3% Mg, 0.5to 1.1% Cu, up to 0.8% Mn, up to 0.9% Zn, up to 0.2% Zr, balance essentially aluminum and incidental elements and impurities. In a considerably broader sense, the invention is considered applicable to aluminum alloys consisting essentially of 0.5 to 1.5% Mg; 0.5 to 1.8% Si, up to 1.2% Cu, up to 1% Mn, up to 1% Zn (zinc); up to 0.4% Cr (chromium); up to 0.5% Ag (silver), up to 0.3% Sc (scandium); up to 0.2% V (vanadium); up to 0.2% Zr (zirconium); up to 0.2% Hf (hafnium); the balance being essentially aluminum and incidental elements and impurities. In referring to an element, "up to" includes zero except that, when an element is stated to be present, such excludes zero since the element is stated to be present.

Within the aforesaid broad limits: (1) silicon is preferably present in amounts of 0.6% or more but preferably not much over 1.5 or 1.6%, more preferably not over 1.3%; (2) magnesium is preferably present in amounts of 0.6% or more, preferably 0.7 or 0.8% but preferably not over 1.3 or 1.4%; (3) copper is preferably present in the alloy and is preferably present in amounts of 0.3 or 0.4%, more preferably 0.5% or more but preferably not over about 0.9 or 1%; (4) manganese is preferably present in the alloy and is present in amounts of 0.25 or 0.3% or more but preferably not over 0.6 or 0.7. In some embodiments, one or more of the following group can be present: 0.1 to 0.9% Zn, 0.05 to 0.35% Cr, 0.05 to 0.4 or 0.45% Ag, 0.03 to 0.3% Sc, 0.03 to 0.2% V, 0.03 to 2% Zr and 0.03 to 0.2% Hf, it sometimes being preferred to limit elements from the group to 2 or 3 or 4 maximum.

The incidental elements referred to can include relatively small amounts of Ti, B, and others. Incidental elements can be present in significant amounts and add desirable or other characteristics on their own without departing from the scope of the invention so long as the alloy remains responsive to the process of the invention in removing altered density bodies or features and the benefits of the invention such as reduce fatigue crack growth rate are achieved.

The alloy described herein can be ingot derived and can be provided as an ingot or slab by casting techniques including those currently employed in the art. A preferred practice is semicontinuous casting of large ingots, for instance 14 or 15 inches or more in thickness by 4 or more feet wide by 15 or more feet in length. Such large ingots are preferred in practicing the invention especially in making large sheet or plate for use as large panels in large commercial aircraft fuselage applications.

The alloy stock is preferably preheated or homogenized at a temperature of at least 1020° F. prior to initial hot rolling. A preferred temperature for alloy 6013, or other alloys having similar amounts of elements, is at least 1030° F. and more preferably at least 1035° or 1040° F. The time at temperature for a large commercial ingot can be about 2 to 20 hours or more, preferably about 2 to 6 hours although short or even possibly nil hold times may be adequate under some conditions since diffusion and solution effects can occur rapidly, especially as the temperature is moving above 1000° F. Large industrial furnaces heating several large ingots can increase metal temperature fairly slowly such that considerable solution effect occur even by the time 1000° F. is reached. While it is preferred to use a very high temperature for the preheat or homogenization of at least 1020° or 1030° F., it may be possible on a less preferred basis in practicing the invention to use a less high temperature such as simply heating the metal to a fairly high temperature for rolling, for instance 1000° or 1010° F. or even 980° or 950° F. or so followed by hot rolling. Nonetheless, the very high preheat/homogenization temperatures can be preferred, for instance where the material is to be clad. In referring to temperatures, such refers to metal temperatures except where indicated otherwise.

The ingot or slab (suitably scalped if needed) can be provided with a roll bonded cladding on either or both sides if desired. Roll bonded cladding is well known in the art. This results in a composite with a core of 6013 or other 6XXX alloy in accordance herewith and a cladding on one or both sides. Each cladding layer typically constitutes about ½ or 1% to about 5% or more of the composite thickness and is applied to one or both roll faces of the core metal (i.e., the large flat rolling faces). As is known, the cladding can be relatively pure or unalloyed aluminum and serves to enhance corrosion resistance by further protecting the core alloy. Aluminum designations known in the art for cladding (typically 1XXX alloys such as 10XX, 11XX, 12XX type alloys, etc.) which are herein considered essentially unalloyed aluminum for purposes of the invention can be used. Other suitable aluminum claddings can contain Mg and Si but preferably in amounts below those in the core alloy or possibly Zn. All such cladding alloys however should contain little or no Cu. The cladding operation can be preceded by some hot rolling of the core metal, for instance to widen the metal over the cast ingot width. The hot roll cladding process can reduce core metal thickness. The invention can be used without cladding because 6XXX alloys are considered to have good corrosion resistance. Cladding, however, can further aid this corrosion resistance.

The bare or clad alloy, as applicable, is hot rolled to reduce its thickness by at least about 20% of its initial (before any hot rolling) thickness, preferably by about 40 or 50% or more, for instance 60 or 65% or more or even 75% or more of its thickness when using large commercial starting stock (for instance around 15 or 20 inches or more thick) using a reversing hot mill which rolls the metal back and forth to squeeze its thickness down. Thus, the initial hot rolling can be done in increments using different rolling mills and can include roll bonding a cladding to the alloy preceded and followed by other hot rolling. It can also include conventional reheating procedures at around 850° F. or so to replace lost heat.

After the hot rolling stage described above, the alloy stock (which may have cooled to room temperature) is heated to at least 1000° F., preferably 1010° or 1020° F. or more, more preferably for 6013 types of alloys to 1030° F. or 1040° F. or more for instance 1050° F. preferably for a substantial amount of time at temperatures at or above 1010° F., preferably about ¼ or ½ hour to around 2 hours. Hold times at these temperatures can be as long as 24 hours or more. However, for a clad product, times above 1010° or 1020° F. are preferably shorter such as about 10 or 15 or 20 minutes to about 1 hour or so, and preferably a high heat-up rate is used, the purpose of shorter times being to reduce diffusion between the core and cladding. The purpose of this inter-roll thermal treatment is to dissolve coarse $Mg_2Si$ particles which may have been coarsened in prior operations such as hot rolling or even be left over from casting, and the heating is desirably carried out at sufficient temperature to dissolve, or substantially dissolve, all, or substantially all, or at least most (for example at least 90%, preferably 95% or more) of the particle volume that can be dissolved at the treatment temperature used, it being remembered that perfect removal may not be practical or economical. It is desired to reach the solvus temperature or higher in this treatment, that is the temperature at which substantially all soluble constituents can dissolve. That temperature varies within alloy composition between around 1000° F. to around 1060° F., high alloy content usually needing higher temperature. If the heating before the initial hot rolling is at a very high temperature, for instance the solvus temperature or higher for a substantial time, such may allow for less time at high temperature in the inter-roll thermal treatment, especially if the metal is quickly rolled.

In using large commercial metal heating furnaces heating several large slabs of metal, the metal heat-up rate allows for substantial amounts of $Mg_2Si$ to dissolve steadily as the metal temperature gets hotter and hotter, especially above 1000° F. As the metal gets above 1000° or 1010° F. or so, a significant amount of $Mg_2Si$ has already been dissolving. Therefore, in heating to a high temperature of about 1040° F. or so, the hold time at 1040° F. can be extremely brief or even practically nil because of the solutionizing that occurs in moving relatively slowly, especially from 1000° F. or so, to that temperature, especially in view of the fact that $Mg_2Si$ undergoes solid state dissolution quickly (especially above 1000° or 1010° F. or so) as is known in the art. It should be noted that it is conventional in producing 6XXX alloys such as 6013 to use a hot line reheat, but this is normally done to replace heat lost in rolling and typically is done at about 850° F. or so.

After the inter-roll thermal treatment just described, the alloy is further hot rolled to reduce the metal thickness of the inter-roll thermally treated metal by at least 20%, preferably 50% or more typically in a reversing hot rolling mill. This is referred to as post treatment hot rolling. The hot rolling, especially the post treatment hot rolling preferably is carried out rather quickly at high mill entrance temperatures, such as entering the rolling mill at 1000° F. or so, and rather rapidly so as to reduce time of exposure to temperatures within about 850° to 950° F. as these temperatures can cause growth of $Mg_2Si$ particles over time, but brief exposures don't do much harm. Thus, it is preferred to avoid letting the metal sit around for extensive periods before starting the post treatment hot rolling stage (i.e., after the inter-roll thermal treatment), it being preferred to hot roll directly following the inter-roll thermal treatment, avoiding delays as practical.

If it is impractical to hot roll the metal directly after the inter-roll thermal treatment, a less preferred embodiment of the invention includes fairly rapidly cooling after the inter-roll thermal treatment, for example by air fans or even mild water spray to a cooler temperature, for instance 700° or 750° F. or so for hot rolling or rather quickly cool further to room temperature and thereafter heating to around 700° or 750° F. or so for hot rolling. Nonetheless, it is typically preferred to use the above-described sequence of quickly hot rolling at high temperatures directly after the inter-roll thermal treatment.

The hot rolling referred to above is typically carried out in reversing hot rolling mills rolling back and forth to squeeze thick metal thinner to make flat plate which can constitute a product gauge (typically around 0.3 to 0.8 or so inch thick) or which, if desired, can be continuously hot rolled to a thinner typically coilable hot rolled stock by passing through a line of several roll stands, the continuous hot rolling being typically at lower temperatures (e.g., 650° F. or less) than at the start of the reversing mill. The continuously hot rolled alloy can constitute a product gauge if desired, for instance a gauge of around 0.1 to 0.3 inch thick or so. Thus, the hot rolling after the interroll thermal treatment can reversing mill roll to a flat rolled product (for example about ⅝ inch or so or thicker) or include a subsequent continuous hot rolling to a continuous hot rolled sometimes coilable product (for example about ⅛ inch thick or so). In the case of a relatively thin final product, for example, 0.1 inch or less, the continuously hot rolled typically coilable stock can be cold rolled to a sheet gauge such as 0.02 to 0.1 or 0.2 inch thick or possibly thicker. If desired, cold rolling can be preceded by a hot line anneal, although it can be preferred to avoid such. The rolled sheet or plate products in accordance with the invention can typically range from 0.02 inch or even less, even 0.01 inch or less up to 0.8 inch thick or more, up to 1 inch or more thick, although sheet-thicknesses of around 0.03 or 0.04 inch to about 0.2 or 0.25 inch or so and light plate up to about ½ or ⅝ or 0.7 or 0.8 inch or so are sometimes preferred.

The alloy after rolling is solution heat treated preferably at high temperatures of at least 1000° F., preferably at least 1010° F. or 1020° F., more preferably at least 1030° or 1040° F. for alloy 6013 or other 6XXX alloys that can sustain these temperatures. The temperatures approach or preferably exceed the solvus temperature. This dissolves magnesium silicide ($Mg_2Si$) that may have formed or coarsened and other phases soluble at treatment temperatures. Typically the solution heat treatment can be carried out for ¼ to 1 or 2 hours for plate (for example ¼ inch to an inch or more thick) and can be for quite a short time for continuously heat treated coilable sheet (about 0.02 to 0.15 inch thick), for instance about 3 or 4 minutes at solution heat temperatures. Then the alloy is rapidly cooled as by quenching in water which can be spray or immersion quenching. The alloy can then be stretched to straighten out distortion such as caused by quenching. Stretching about 1 or 2 or 3% is known for this purpose. If desired, the alloy sheet or plate can be shaped by bending, roll forming, stretch forming or other metal forming procedures after quenching (and typically after naturally aging to a stable mechanical property level, i.e., T4 condition) since the metal in this condition is softer and weaker than the T6 artificial aged condition and is thus easier to shape. Also the improved sheet or plate can be age-formed, that is, shaped by a forming operation while being heated to or held at artificial aging temperatures.

After quenching, the alloy (with or without post quench shaping) is artificially aged to develop its desired high strength. This can be carried out by heating to about 300° or 350° or 400° F. or more, preferably about 350° to 375° F. for about 8 to 4 hours. Typically desirable aging treatments are about 4 hours at 375° or 8 hours at 350° F. Artificial aging is described in terms of time at temperature but, as is known, artificial aging can proceed in programmed furnaces to take into account the artificial aging effects of heating up to and cooling down within precipitation hardening temperatures.

Such effects are known and are described in U.S. Pat. No. 3,645,804 to Ponchel, the entire content of which is incorporated herein by reference. Accordingly, referring herein to artificial aging time at temperature is intended to encompass equivalent precipitation hardening effects in ramping up and down in the effective artificial aging temperatures which can shorten or even eliminate a hold time at one given temperature. Also, as stated above, the improved sheet or plate product can be age formed by shaping during artificial aging. Age forming techniques are known in the aft. It may be advantageous to use two or three stages of an artificial aging treatment, for instance around 340° F. or so then over 400° F. or so, with or without a third stage at around 340° F. or so which may increase corrosion resistance without excessive adverse side effects such as excessive strength loss.

The resulting products exhibit a substantially reduced number of microstructural reduced/altered density features of the type earlier described, The improved 6013 alloy product when examined under SEM as described above exhibits a substantial freedom from the described low density features or at least a greatly reduced amount thereof. Substantial freedom from the features as used herein means not more than 25,000 low density features 1 $\mu$m or more in major dimension in an equivalent square inch. However, speaking more broadly, typical improved products may exhibit not more than about 40,000 such features in the aforesaid SEM exam in a square inch, preferably not more than about 32,500 or 30,000 such features in a square inch which contrasts substantially with the prior art 6013 product typically containing around 50,000 to 125,000 or so such features in a square inch. As explained in more detail below, five actual measurements at 500× magnification can cumulatively total an area of about 0.000315 square inch. The features counted in the five actual counts then apply to the 0.000315 square inch total area. This is then converted to what would be in a square inch for convenience. Hence, in referring to a number of features in a square inch, or equivalent square inch, such is intended to include measuring less (or possibly more) than a cumulative square inch (typically in very small view areas) and converting to a square inch by calculation.

The improved products produced in accordance with the invention exhibit improved fatigue properties, especially a reduced rate of crack growth under fatigue conditions (reduced fatigue crack growth). Equally significant is the fact that this improvement is achieved without excessive adverse side effects such as strength or toughness or corrosion resistance decrease. The improved material in 6013 type alloys has essentially the same good strength and corrosion resistance and the same or better fracture toughness characteristics as prior 6013 type products. For a material having good fracture toughness, a structure designer's focus for damage tolerance can shift to fatigue crack growth rate.

Resistance to cracking by fatigue is a very desirable property. The fatigue cracking referred to occurs as a result of repeated loading and unloading cycles, or cycling between a high and a low load such as when a fuselage swells with pressurization and contracts with depressurization. The loads during fatigue are below the static ultimate or tensile strength of the material measured in a tensile test and they are typically below the yield strength of the material. If a crack or crack-like defect exists in a structure, repeated cyclic or fatigue loading can cause the crack to grow. This is referred to as fatigue crack propagation. Propagation of a crack by fatigue may lead to a crack large enough to propagate catastrophically when the combination of crack size and loads are sufficient to exceed the material's fracture toughness. Thus, an increase in the resistance of a material to crack propagation by fatigue offers substantial benefits to aerostructure longevity and safety. The slower a crack propagates, the better. A rapidly propagating crack in an airplane structural member can lead to catastrophic failure without adequate time for detection, whereas a slowly propagating crack allows time for detection and corrective action or repair. Fatigue crack growth rate testing is well known in the art. For instance, ASTM E647-99 describes such testing.

The rate at which a crack in a material propagates during cyclic loading is influenced by the length of the crack. Another important factor is the difference between the maximum and the minimum loads between which the structure is cycled. One measurement including the effects of crack length and the difference between maximum and minimum loads is called the cyclic stress intensity factor range or $\Delta K$, having units of ksi$\sqrt{\text{in}}$, similar to the stress intensity factor used to measure fracture toughness. The stress intensity factor range ($\Delta K$) is the difference between the stress intensity factors at the maximum and minimum loads. Another measure affecting fatigue crack propagation is the ratio between the minimum and the maximum loads during cycling, and this is called the stress ratio and is denoted by R, a ratio of 0.1 meaning that the minimum load is one-tenth of the maximum load.

The fatigue crack propagation rate can be measured for a material using a test coupon containing a crack. A typical test specimen or coupon is a rectangular sheet having a notch or slot cut in its center extending in a cross-wise direction (across the middle of the width; normal to the length), the slot having pointed or sharp ends. The test coupon is subjected to cyclic loading and the crack grows at the end(s) of the slot. After the crack reaches a predetermined length, the length of the crack is measured periodically. The crack growth rate can be calculated for a given increment of crack extension by dividing the change in crack length (called $\Delta a$) by the number of loading cycles ($\Delta N$) which resulted in that amount of crack growth. The crack propagation rate is represented by $\Delta a/\Delta N$ or 'da/dN' and has units of inches/cycle.

In a constant load amplitude test, the tensile load or pull loads for high load and low load are the same through the fatigue cycling. This causes the $\Delta K$ level in terms of stress intensity (ksi $\sqrt{\text{in}}$) to increase as the crack grows during the test. This increase becomes more rapid as the test progresses, and the precision can thereby suffer in later stages as the crack grows significantly in length.

Still another technique in testing is use of a constant $\Delta K$ gradient. In this technique, the otherwise constant amplitude load is reduced toward the latter stages of the test to slow down the rate of $\Delta K$ increase. This adds a degree of precision by slowing down the time during which the crack grows to provide more measurement precision near the end of the test when the crack tends to grow faster. This technique allows the $\Delta K$ to increase at a more constant rate than achieved in ordinary constant load amplitude testing.

The fatigue crack growth rate test used herein is performed on a 15.75 inch (400 mm) wide M(T) (middle-cracked tension) specimen according to ASTM E647-99. The specimen free length between grips is at least 24 inches and the initial notch length is $2a_i$=1.417 inch ("A" is one-half of the "crack" or slot length; "2a" is the entire length.). The final crack length is about $2a_f$=5.2 inches. The specimen is gripped across the full width with bolt-down wedge grips. Loads are applied at a stress ratio, R, of 0.1 using a ΔK-increasing gradient which simulates a constant-stress-amplitude test on a 15.75-inches wide specimen having a crack or slot length range from 2a=0.142 inch to 5.2 inches using a maximum stress across the entire 15.75-inch specimen of 17.4 ksi. The crack length range of the test specimen is linearly mapped to the crack length range from a constant-stress-amplitude test, and ΔK is applied to the test specimen at the same level that would be applied to the constant-stress-amplitude specimen at the equivalent mapped crack length. In other words, the test is conducted using control of the K gradient as would be done in a constant K gradient test except the gradient is continuously charged to match the K gradient that would be achieved in a constant stress amplitude test as described above. The range of ΔK covered by this test is from about 7.7 to about 50 ksi √inch. There is no explicit precracking step, but data from approximately the first 0.040 inch of crack growth from the machined notch are not used in determining crack growth rate. Thus, all the precracking requirements of ASTM B647-99 are met.

Crack length is measured using the compliance method, and the test is controlled with a commercially available fatigue crack growth system that was modified to provide the capability to apply ΔK as a function of crack length as described above. The test is started at a frequency of 8 Hz, but to maintain a high degree of load control, the frequency is reduced to 4 Hz when the crack growth rate reaches $3.9\times10^{-5}$ in/cycle and again to 2 Hz when the crack growth rate reaches $2.7\times10^{-4}$ in/cycle. Tests are conducted in laboratory air maintained within a temperature range of 64 to 80° F. and a relative humidity range of 20 to 55 percent.

Compliance measurements and cycle count are recorded automatically during the test. At the end of the test, the specimen is pulled apart and visual crack length measurements are taken from the specimen centerline to both ends of the crack. The allowable difference between the individual final crack length measurements in ASTM E647-99 is 0.025W, or about 0.394 inch. If the measured difference exceeds this limit, then a linear estimate is made to determine at what crack length the limit was exceeded. If the crack length at any fatigue crack growth rate point exceeds that estimate, then the data are not used.

The compliance measurements are adjusted as described in ASTM E647-99 so that the initial and final compliance crack lengths agree with the initial and final average visual crack lengths. The seven-point incremental polynomial method in ASTM E647-99 is used to calculate the fatigue crack growth rate (da/dN) at various crack lengths. A tabulation of cycle count, applied load, crack length, da/dN, and ΔK is produced, from which standard plots of log(da/dN) as a function of log(ΔK) can be made.

In order to determine a value of da/dN at a target ΔK, the tabular da/dN vs. ΔK data are searched in sequence until the last ΔK point less than the target ΔK is found. A linear regression is performed on five log(da/dN) and log(ΔK) data pairs (the point found, the two previous points, and the two subsequent points). The target ΔK value is substituted into the resulting equation to determine the da/dN value at the target ΔK. In this way, a tabular listing can be made of the 5-point average da/dN at each selected target ΔK point. These are commonly at ΔK=10, 15, 20, 25, 30, 35, 40, and 45 ksi √inch but other ΔK's can be used or fatigue crack growth rates for other ΔK's can be calculated from the aforesaid ΔK's by interpolation.

The fatigue crack propagation rates for sheet or plate in accordance with the invention are much slower than the prior 6013-T6 alloy sheet or plate made by standard production methods when measured using a center cracked tension panel and tested at cyclic stress intensity factors of ΔK greater than 20 ksi √in. specially at ΔK of 25 or 30 ksi or more. The data show that the fatigue crack propagation rates of the invention product are dramatically reduced when compared to previous 6013-T6 products especially at higher values of ΔK. For example, at ΔK=40 ksi √in, the fatigue crack propagation rate of the sheet according to the invention in the LT is less than 60% of the crack propagation rate of standard 6013-T6 alloy sheet. That is, a crack in standard 6013-T6 alloy sheet will grow 69% faster than a crack in the invention product sheet.

EXAMPLE

Several commercial size 6013 alloy ingots suitable for rolling into large sheet or plate were cast. The ingots, over 20 inches thick, were homogenized at about 1040° F. for almost 8 hours and then hot rolled in a reversing mill directly out of the furnace starting at a rolling temperature in the neighborhood of 810° F. or so. The metal was widened in the initial hot roll stage and was then scalped, reheated to about 850° F., and hot roll bond clad with alloy 1145 and further hot rolled to a thickness of about 7 inches, a total reduction of over 50% of the original ingot thickness. Then the metal was heated to 1040° F. for 9 hours and then directly hot rolled in a reversing mill to a thickness of about 1 inch then continuous hot rolled to about ¼ inch thick and then cold rolled to about 0.18 inch thick. The metal was solution heat treated at about 1040° F. for about 20 minutes, quenched in water and then stretched to remove distortion.

The sheet so produced in accordance with the invention exhibited about an average of 17 reduced density features in a calculated equivalent square inch, a marked decrease over conventionally produced 6013 products of closely similar composition to the improvement material which exhibited about 279 such features in a calculated equivalent square inch. Most or all of the reduced density features were 2 μm or larger.

In each case, five measurements at 500× magnification counting the reduced density features at or near the mid-thickness of the sheet for a material were taken from the center of a sheet width sample and totaled, and five more near the edge were also totaled. The total area of five such measurements was about 0.000315 square inch. The cumulative count of the defects in each five measurement group are totaled in Table 1 along with a comparison with conventionally produced 6013. Also included in Table 1 is the equivalent reduced density feature count for a square inch. In referring to a number of features in an equivalent square inch, such is intended to include a number of individual counts at, say 500×, such as 3 or 4 counts to about 20 or so (or more) and converting such to a square inch by calculation.

TABLE 1

| | No. of Features | | No. of Features in a Square Inch | |
|---|---|---|---|---|
| Process | Center | Edge | Center | Edge |
| Invention | 6 | 3 | 19,047 | 9,523 |
| Invention | 0 | 1 | 0 | 3,174 |
| Invention | 0 | 2 | 0 | 6,349 |
| Invention | 1 | 8 | 3,174 | 25,397 |
| Old | 44 | * | 139,682 | * |

*Edge not measured

Strength properties for the sheet so produced in accordance with the invention in T6 temper are listed in Table 2 and fatigue crack growth rates in Tables 3A and 3B and compared with commercially produced 6013-T6 alclad sheet.

TABLE 2

| | Commercial 6013 | | Improved 6013 | |
|---|---|---|---|---|
| | ksi | (MPa) | ksi | (MPa) |
| Strength | | | | |
| Yield in tension L | 51.5 | (355) | 50.9 | (351) |
| Ultimate in tension L | 53.3 | (371) | 53.2 | (367) |
| Yield in tension LT | 48.4 | (344) | 48.4 | (344) |
| Ultimate in tension LT | 52.9 | (365) | 53.3 | (368) |
| Elongation | | | | |
| % Elongation L | 10.3 | | 11.3 | |
| % Elongation LT | 11.2 | | 11.2 | |
| Fracture Toughness | ksi√in | (MPa√m) | ksi√in | (MPa√m) |
| $K_{app}$ L-T | 96.8 | (106.4) | 99.6 | (109.5) |
| $K_c$ L-T | 137.0 | (150.6) | 139.7 | (153.5) |
| $K_{app}$ T-L | 90.2 | (99.1) | 92.5 | (101.6) |
| $K_c$ T-L | 127.8 | (140.4) | 137.4 | (151.0) |

Notes:
L = longitudinal
LT = long transverse

TABLE 3A

| | Fatigue Crack Growth Rate 6013 | | | |
|---|---|---|---|---|
| | ΔK | Mean Crack Growth Rate (in/cycle) | | % change[1] Invention vs. |
| Direction | ksi √in | Commercial | Improved | Commercial |
| L-T | 10 | $8 \times 10^{-6}$ | $7.8 \times 10^{-6}$ | −2.5 |
| L-T | 15 | $2.4 \times 10^{-5}$ | $2.5 \times 10^{-5}$ | +4.2 |
| L-T | 20 | $5.2 \times 10^{-5}$ | $4.5 \times 10^{-5}$ | −13.5 |
| L-T | 25 | $1.2 \times 10^{-4}$ | $7.8 \times 10^{-5}$ | −35 |
| L-T | 30 | $2.2 \times 10^{-4}$ | $1.4 \times 10^{-4}$ | −36.4 |
| L-T | 35 | $3.8 \times 10^{-4}$ | $2.3 \times 10^{-4}$ | −39.5 |
| L-T | 40 | $6.1 \times 10^{-4}$ | $3.6 \times 10^{-4}$ | −41 |
| L-T | 45 | $1 \times 10^{-3}$ | $6 \times 10^{-4}$ | −40 |
| T-L | 10 | $7.6 \times 10^{-6}$ | $7.5 \times 10^{-6}$ | −1.3 |
| T-L | 15 | $2.4 \times 10^{-5}$ | $2.4 \times 10^{-5}$ | 0 |
| T-L | 20 | $5.4 \times 10^{-5}$ | $4.7 \times 10^{-5}$ | −13 |
| T-L | 25 | $1.2 \times 10^{-4}$ | $9.2 \times 10^{-5}$ | −23.3 |
| T-L | 30 | $2.5 \times 10^{-4}$ | $1.8 \times 10^{-4}$ | −28 |
| T-L | 35 | $4.4 \times 10^{-4}$ | $3 \times 10^{-4}$ | −31.8 |
| T-L | 40 | $8.2 \times 10^{-4}$ | $5.4 \times 10^{-4}$ | −34.1 |
| T-L | 45 | $1.3 \times 10^{-3}$ | $9.1 \times 10^{-4}$ | −30 |

Notes:
[1]% change: minus(−) means reduction, i.e., % improvement over commercial product Growth rate data are rounded off to nearest tenth. Data for ΔK = 10 & 15 ksi √in are considered insignificant but are included for completeness. Change of ±5% or less is considered insignificant.

TABLE 3B

| | Fatigue Crack Growth Rate 6013 | | | |
|---|---|---|---|---|
| | ΔK | Mean Crack Growth Rate (mm/cycle) | | % change[1] Invention vs. |
| Direction | MPa √m | Commercial | Improved | Commercial |
| T-L | 10 | $1.5 \times 10^{-4}$ | $1.3 \times 10^{-4}$ | −13 |
| T-L | 15 | $4.8 \times 10^{-4}$ | $4.5 \times 10^{-4}$ | −6 |
| T-L | 20 | $9.7 \times 10^{-4}$ | $8.8 \times 10^{-4}$ | −9 |
| T-L | 25 | $2.0 \times 10^{-3}$ | $1.5 \times 10^{-3}$ | −25 |
| T-L | 30 | $3.8 \times 10^{-3}$ | $2.5 \times 10^{-3}$ | −34 |
| T-L | 35 | $6.6 \times 10^{-3}$ | $4.5 \times 10^{-3}$ | −32 |
| T-L | 40 | $1.2 \times 10^{-2}$ | $7.4 \times 10^{-3}$ | −38 |
| T-L | 50 | $2.8 \times 10^{-2}$ | $2.0 \times 10^{-2}$ | −29 |

TABLE 3B-continued

| | Fatigue Crack Growth Rate 6013 | | | |
|---|---|---|---|---|
| | ΔK | Mean Crack Growth Rate (mm/cycle) | | % change[1] Invention vs. |
| Direction | MPa √m | Commercial | Improved | Commercial |
| L-T | 10 | $1.6 \times 10^{-4}$ | $1.4 \times 10^{-4}$ | −12 |
| L-T | 15 | $5.0 \times 10^{-4}$ | $4.8 \times 10^{-4}$ | −4 |
| L-T | 20 | $1.0 \times 10^{-3}$ | $9.3 \times 10^{-4}$ | −7 |
| L-T | 25 | $2.2 \times 10^{-3}$ | $1.6 \times 10^{-3}$ | −27 |
| L-T | 30 | $4.1 \times 10^{-3}$ | $2.6 \times 10^{-3}$ | −36 |
| L-T | 35 | $6.6 \times 10^{-3}$ | $3.8 \times 10^{-3}$ | −42 |
| L-T | 40 | $1.1 \times 10^{-2}$ | $5.6 \times 10^{-3}$ | −49 |
| L-T | 50 | $2.3 \times 10^{-2}$ | $1.2 \times 10^{-2}$ | −48 |

Notes:
[1]% change: minus(−) means reduction, i.e., % improvement over commercial product. Growth rate data are rounded off to nearest tenth. Data for ΔK = 10 & 15 ksi √in are considered insignificant but are included for completeness. Change of ±5% or less is considered insignificant.

It can be seen that tension and compression yield and ultimate strength values are similar between the invention product and commercial 6013. However, fracture toughness of the invention product is improved some (or at least not reduced) and fatigue properties are very much improved. Fatigue crack growth rate is reduced by as much as 25 or 30% or more at the important high ΔK values in comparison with commercially produced 6013-T6.

The improvement in fatigue crack growth rate at ΔK levels of 20 ksi √in or more and especially 25 ksi √in or more are very substantial. Accordingly, it is estimated that the improved product can set maximum limits (for example guaranteeable) for fatigue crack growth rates for ΔK of 20 ksi √in or higher such that one or more of the maximum levels in Table 4 are satisfied. At ΔK's other than those in Table 4 (for instance ΔK's between those listed) the maximum can be determined by interpolation and Table 4 as referred to in the claims is intended to refer to one or more of the values in Table 4, including one or more values for ΔK's between 2 ΔK's in the Table determined by interpolation.

TABLE 4

| | Maximum Fatigue Crack Growth Rate | |
|---|---|---|
| ΔK (ksi √in) | L-T Dir. Max. Growth Rate in/Cycle | T-L Dir. Max. Growth Rate in/Cycle |
| 20 | $4.9 \times 10^{-5}$ | |
| 25 | $9.5 \times 10^{-5}$ | $1.1 \times 10^{-4}$ |
| 30 | $2 \times 10^{-4}$ | $2.2 \times 10^{-4}$ |
| 35 | $3.5 \times 10^{-4}$ | $4.2 \times 10^{-4}$ |
| 40 | $5.5 \times 10^{-4}$ | $7 \times 10^{-4}$ |
| 45 | $8.5 \times 10^{-4}$ | $1.1 \times 10^{-3}$ |

The reduction of altered or reduced density microscopic features resulting from the practice of the invention and the associated improvement in fatigue crack growth rate, especially in view of little or no substantial adverse "side effect" decline in other properties such as corrosion resistance or strength, makes the improved products very useful in applications such as large fuselage panels in large aircraft fuselages, including belly fuselage panels.

Such panels have improved fatigue properties in terms of reduced fatigue crack growth rate. The improved alloy sheet and plate panels are weldable such that stringer members can be welded to the sheet or plate panels to reinforce them (rather than riveting the elongate stringers to the panels as is now largely the case) thereby providing an improved stringer reinforced panel. The panels, for instance before welding stringers, can be machined or chemically milled to remove metal and reduce thickness at selective strip areas to leave upstanding elongate ribs between the elongate chemically milled or machined strip areas. The upstanding ribs provide good sites for welding stringers thereto for reinforcement. Where the fuselage sheet is 6013, the stringers can be 6013 or other 6XXX type alloy extrusions or roll formed sheet members. Hence, the invention provides improved rolled sheet and plate for aircraft applications such as fuselage skin panels and for improved aircraft fuselages and fuselage portions and subassemblies for large size jet aircraft such as large commercial size passenger and freight aircraft.

The extent of the invention's improvement over conventionally produced 6013-T6 commercial products in reduced (lower) fatigue crack growth rate is pronounced, especially at medium to higher levels of ΔK such as 20 ksi √in to 45 ksi √in or, even more importantly, at ΔK levels of 25 ksi √in and higher such as ΔK of 25 ksi √in to 40 ksi √in or 45 or more ksi √in ΔK. The fatigue crack growth rate of the invention represents an improvement of at least 10 or 20% over conventional 6013-T6 (crack grows at least 10 to 20% slower than for conventional 6013-T6), and especially at ΔK levels above 20, the invention represents an improvement of at least 10% and up to 40% or even more (at 40% improvement a crack grows 40% less quickly than conventional 6013-T6).

In referring to improvements over 6XXX alloys or over 6013 or over 6013-T6, such generally and preferably refers to similar alloys and product form, for instance plate versus plate, clad sheet versus clad sheet, or at least to 6XXX alloy, 6013 alloy product forms expected to have similar property levels to the product form being compared.

Aside from the obvious safety related advantage, another advantage of the lower rate of growth of cracks by fatigue achieved by the invention is that it allows the aircraft users to increase the intervals between inspection of cracks and defects, thereby reducing the costs of the inspections and reducing costs of operation and increasing the value of the aircraft to the user. The invention product also provides for increasing the number of pressurization/depressurizing or other stressful cycles further reducing operation costs and enhancing the aircraft.

Fatigue measuring and testing has been described in some particularity, it being understood that the aforesaid testing is intended to illustrate the good property levels of the invention but not necessarily in limitation thereof. For instance, other methods of testing may be developed over time and the good performance of the invention can be measured by those methods as well. It is be believed that invention product properties that are generally or substantially equivalent to the described test results can be demonstrated with other test methods.

The invention provides products suitable for use in large airplanes, such as large commercial passenger and freight airplanes, or other aircraft or aerospace vehicles. Such products, themselves, are typically large, typically several feet in length, for instance 5 or 10 feet up to 25 or 30 feet or even 50 feet or more, and 2 to 6 or 7 feet or more wide. Yet even in these large sizes, the invention products achieve good property combinations. Hence, a particular advantage of the invention is sufficiently large size products to be suited to major structure components in aircraft, such as major aircraft fuselage components and possibly other components. The invention sheet and plate product (collectively referred to as rolled stock) can be shaped into a member for an airplane, such as a fuselage component or panel, and the airplane can utilize the advantage of the invention as described. The shaping referred to can include bending, stretch forming, machining, chemical milling and other shaping operations, and combinations of shaping operations, known in the art for shaping panels or other members for aircraft, aerospace or other vehicles. Forming involving bending or other plastic deformation can be performed at room temperature or at elevated temperatures such as around 200° to 400° or so. If elevated temperatures are used in forming, such can be used in an artificial aging treatment as earlier described. The member can also include attached stiffeners or strengtheners such as structural beams attached by welding or other means.

When referring to large jet aircraft such includes aircraft similar in size to Boeing 747, 767, 757, 737, 777 and Airbus A319, A320, A318, A340, A380 and military C17 and KC135. While the invention is especially suited for fuselage skins on large jet aircraft, it also offers substantial advantages for smaller planes such as regional or private/business jets and possibly even smaller aircraft. While the invention is particularly suited to fuselage skins, it also may find other applications such as automotive sheet, railroad car sheet, and other uses.

Unless indicated otherwise, the following definitions apply herein:

(a) The term "ksi" is equivalent to kilopounds per square inch.

(b) percentages for a composition refer to % by weight.

(c) The term "ingot-derived" means solidified from liquid metal by a known or subsequently developed casting process rather than through powder metallurgy techniques. This term shall include, but not be limited to, direct chill casting, electromagnetic continuous casting, and any variations thereof.

(d) In stating a numerical range for an element of a composition or a temperature or other process matter or an extent of improvement or any other matter herein, and apart from and in addition to the customary rules for rounding off numbers, such is intended to specifically designate and disclose each number, including each fraction and/or decimal, between the stated minimum and maximum for said range. (For example, a range of 1 to 10 would disclose 1.1, 1.2 . . . 1.9, 2, 2.1, 2.2 . . . and so on, up to 10, including every number and fraction or decimal therewithin.) "Up to x", for instance for an element that is stated to be present in the alloy or other matter stated to be present or performed, means "x" and every number less than "x", for instance up to 5 would disclose 0.01 . . . 0.1 . . . 1 and so on up to 5, whereas "up to x", for an element or other matter not stated as actually present includes the same along with zero. "At least y" (or "y or higher") means "y" and every practical number or value above "y". For instance, a temperature of "at least 1020° F." (or 1020° F. or higher) means 1020° F. and higher temperature but not destructive temperatures such as melting, or other harmful excess.

(e) Notwithstanding (d) just preceding, when referring to a minimum (for instance for strength or toughness) or to a maximum (for instance for fatigue crack growth rate), for a mechanical property level, such refers to a level at which specifications for materials can be written or a level at which a material can be guaranteed or a level that an airframe builder (subject to safety factor) can rely on in design. In some cases, it can have a statistical basis such as wherein 99% of the product conforms or is expected to conform with 95% confidence using standard statistical methods.

(f) In discussing alloys by specific numbers such as 6013 such refers to Aluminum Association (AA) alloys. When referring to an alloy class designation, such refers to AA class, for instance 6XXX or 6XXX type alloys, such refers to aluminum alloys containing magnesium and silicon as major alloy additions, whether or not the alloy is registered with the Aluminum Association.

Having described the presently preferred embodiments, it is to be understood that the invention may be otherwise embodied within the scope of the appended claims.

What is claimed is:

1. Improved aluminum sheet or plate product comprising an alloy consisting essentially of 0.6 to 1.6% Si, 0.6 to 1.6% Mg, 0.2 to 1.1% Cu and 0.2 to 0.9% Mn, balance essentially aluminum and incidental elements and impurities, said sheet or plate having not more than 40,000 features revealed by SEM as reduced density features greater than 1 $\mu$m in major axis in an equivalent square inch and having improved fatigue crack growth rate at $\Delta K$ levels of 20 ksi $\sqrt{in}$ or higher.

2. The improved product of claim 1, wherein said alloy contains 0.6 to 1% Si, 0.8 to 1.2% Mg, 0.6 to 1.1% Cu and 0.2 to 0.8% Mn, balance essentially aluminum and incidental elements and impurities, and having not more than 32,500 of said features in an equivalent square inch.

3. The improved product of claim 2, which is not more than ⅝ inch thick and has substantial freedom from said features.

4. The improved product of claim 3 which has one or both sides clad with an aluminum composition different than said alloy.

5. The improved product of claim 2 which has one or both sides clad with an aluminum composition different than said alloy.

6. The improved product of claim 2 wherein said product has a maximum fatigue crack growth rate in accordance with Table 4.

7. The improved product of claim 6 which has one or both sides clad with an aluminum composition different than said alloy.

8. The improved product of claim 1 which has one or both sides clad with an aluminum composition different than said alloy.

9. The product of claim 1 which is sheet not over 0.25 inch thick.

10. The product of claim 1 which is light gauge plate not more than about ⅝ inch thick.

11. Improved aluminum sheet or plate product comprising an alloy consisting essentially of 0.6 to 1% Si, 0.8 to 1.2% Mg, 0.6 to 1.1% Cu and 0.2 to 0.8% Mn, balance essentially aluminum and incidental elements and impurities, said sheet or plate having not more than 40,000 features revealed by SEM as reduced density features greater than 1 $\mu$m in major axis in an equivalent square inch and having a maximum fatigue crack growth rate in accordance with one or more of the maximum values in Table 4.

12. The improved product of claim 11 which has not more than 32,500 said features in an equivalent square inch.

13. The improved product of claim 12 which is not more than 0.5 inch thick and has substantial freedom from said features.

14. The improved product of claim 13 which has one or both sides clad with an aluminum composition different than said alloy.

15. The improved product of claim 12 which has one or both sides clad with an aluminum composition different than said alloy.

16. The product of claim 12 which is sheet not over 0.25 inch thick.

17. The product of claim 12 which is light gauge plate not more than about 0.8 inch thick.

18. The improved product of claim 11 wherein said alloy contains 0.6 to 1% Si, 0.8 to 1.2% Mg, 0.6 to 1.1% Cu and 0.2 to 0.8% Mn.

19. The improved product of claim 18 which has one or both sides clad with an aluminum composition different than said alloy.

20. The improved product of claim 11 which has one or both sides clad with an aluminum composition different than said alloy.

21. The improved product of claim 11 which is not more than 0.8 inch thick.

22. The product of claim 11 which is sheet not over 0.25 inch thick.

23. The product of claim 11 which is light gauge plate not more than about 0.8 inch thick.

24. The product of claim 11 which is sheet not over 0.25 inch thick and has substantial freedom from said features.

25. The product of claim 11 which is light gauge plate not more than about 0.8 inch thick and has substantial freedom from said features.

26. Improved aluminum sheet or plate product comprising an alloy consisting essentially of 0.6 to 1.2% Si, 0.8 to 1.2% Mg, 0.6 to 1.2% Cu; and either: (i) 0.2 to 0.8% Mn; or (ii) 0.5 to 0.9% Zn and 0.2 to 0.4% Cr; balance essentially aluminum and incidental elements and impurities, said sheet or plate having not more than 40,000 features revealed by SEM as reduced density features greater than 1 $\mu$m in major axis in an equivalent square inch and having improved fatigue crack growth rate at $\Delta K$ levels of 20 ksi $\sqrt{in}$ or higher.

27. The product of claim 26 having not more than 32,500 of said features in an equivalent square inch.

28. The improved product of claim 28 which is not more than 0.5 inch thick and has substantial freedom from said features.

29. Improved aluminum sheet or plate consisting essentially of 0.6 to 1.2% Si, 0.8 to 1.2% Mg, 0.6 to 1.2% Cu; and either: (i) 0.2 to 0.8% Mn; or (ii) 0.5 to 0.9% Zn and 0.2 to 0.4% Cr; balance essentially aluminum and incidental elements and impurities, said sheet or plate having not more than 40,000 features revealed by SEM as reduced density features greater than 1 $\mu$m in major axis in an equivalent square inch and having improved fatigue crack growth rate in accordance with one or more of the maximum values in Table 4.

30. The product of claim 29 having not more than 32,500 of said features in an equivalent square inch.

31. The improved product of claim 29 which is not more than ⅝ inch thick and has substantial freedom from said features.

32. Improved skin member on a large jet aircraft, said skin member comprising an improved sheet or plate comprising an alloy consisting essentially of 0.6 to 1.6% Si, 0.6 to 1.6% Mg, 0.2 to 1.2% Cu and 0.2 to 0.9% Mn, balance essentially aluminum and incidental elements and impurities, said sheet or plate having not more than 40,000 features revealed by SEM as reduced density features greater than 1 $\mu$m in major axis in an equivalent square inch.

33. The improved skin member of claim 32 wherein said skin member is a fuselage belly member.

34. The improved skin member of claim 32 wherein said skin member is a fuselage member.

35. Improved skin member on a large jet aircraft, said skin member comprising an improved sheet or plate comprising an alloy consisting essentially of 0.6 to 1.2% Si, 0.8 to 1.2% Mg, 0.6 to 1.2% Cu; and either: (i) 0.2 to 0.8% Mn; (ii) 0.5 to 0.9% Zn and 0.2 to 0.4% Cr; balance essentially aluminum and incidental elements and impurities, said sheet or plate having not more than 40,000 features revealed by SEM as reduced density features greater than 1 $\mu$m in major axis in an equivalent square inch and having improved fatigue crack growth rate at $\Delta K$ levels of 20 ksi $\sqrt{in}$ or higher.

36. The improved skin member of claim 35 wherein said skin member is a fuselage belly member.

37. The improvement of claim 36 wherein said sheet or plate product includes a cladding on one or both faces thereof, said cladding being of a different composition than said alloy.

38. The improved skin member of claim 35 wherein said skin member is a fuselage member.

39. The improvement of claim 35 wherein said sheet or plate product has not more than 32,500 of said features in an equivalent square inch.

40. The improvement of claim 39 wherein said sheet or plate product has a maximum fatigue crack growth rate in accordance with one or more of the maximum values in Table 4.

41. The improvement of claim 40 wherein said sheet or plate product includes a cladding on one or both faces thereof, said cladding being of a different composition than said alloy.

42. The improvement of claim 39 wherein said sheet or plate product includes a cladding on one or both faces thereof, said cladding being of a different composition than said alloy.

43. The improvement of claim 35 wherein said skin member is a fuselage member and said sheet or plate product is substantially free of said features and has a maximum fatigue crack growth rate in accordance with one or more of the maximum values Table 4.

44. The improvement of claim 43 wherein said sheet or plate product includes a cladding on one or both faces thereof, said cladding being of a different composition than said alloy.

45. The improvement of claim 35 wherein said sheet or plate product includes a cladding on one or both faces thereof, said cladding being of a different composition than said alloy.

46. An improved aircraft fuselage or fuselage portion comprising one or more fuselage skin shaped sheet or plate members comprising an alloy consisting essentially of 0.6 to 1% Si, 0.8 to 1.2% Mg, 0.6 to 1.1% Cu and 0.1 to 0.8% Mn, balance essentially aluminum and incidental elements and impurities, said sheet or plate having not more than 40,000 features revealed by SEM as reduced density features greater than 1 $\mu$m in major axis in an equivalent square inch and having improved fatigue crack growth rate at $\Delta K$ levels of 20 ksi $\sqrt{in}$ or higher.

47. The improved fuselage or fuselage portion according to claim 46 which comprises two or more such skin members joined together by welding.

48. The improved fuselage or fuselage portion according to claim 46 which comprises elongate stringers welded to one or more such skin members.

49. The improvement of claim 46 wherein said sheet or plate product includes a cladding on one or both faces thereof, said cladding being of a different composition than said alloy.

50. The improvement of claim 46 wherein said sheet or plate member has not more than 32,500 of said features in an equivalent square inch.

51. The improvement of claim 50 wherein said sheet or plate member has a maximum fatigue crack growth rate in accordance with one or more of the maximum values in Table 4.

52. The improvement of claim 46 wherein said sheet or plate member is substantially free of said features and has a maximum fatigue crack growth rate in accordance with one or more of the maximum values in Table 4.

53. Improved aluminum sheet or plate product comprising an alloy consisting essentially of 0.6 to 1% Si, 0.8 to 1.2% Mg, 0.6 to 1.1% Cu and 0.2 to 0.8% Mn, balance essentially aluminum and incidental elements and impurities, said sheet or plate having a maximum fatigue crack growth rate in accordance with one or more of the maximum values in Table 4.

54. The improved product of claim 53 which has one or both sides clad with an aluminum composition different than said alloy.

55. The product of claim 53 which is sheet not over 0.25 inch thick.

56. The product of claim 53 which is light gauge plate not more than about ⅝ inch thick.

57. Improved aluminum sheet or plate product comprising an alloy consisting essentially of 0.6 to 1.6% Si, 0.6 to 1.6% Mg, 0.2 to 1.1% Cu and 0.2 to 0.9% Mn, balance essentially aluminum and incidental elements and impurities, said sheet or plate having a maximum fatigue crack growth rate in accordance with one or more of the maximum values in Table 4.

58. The improved product of claim 57 which has one or both sides clad with an aluminum composition different than said alloy.

59. The product of claim 57 which is sheet not over 0.25 inch thick.

60. The product of claim 57 which is light gauge plate not more than about 0.8 inch thick.

61. Improved aluminum sheet or plate consisting essentially of 0.6 to 1.2% Si, 0.8 to 1.2% Mg, 0.6 to 1.2% Cu; and either: (i) 0.2 to 0.8% Mn; or (ii) 0.5 to 0.9% Zn and 0.2 to 0.4% Cr; balance essentially aluminum and incidental elements and impurities, said sheet or plate having improved fatigue crack growth rate in accordance with one or more of the maximum values in Table 4.

62. The improved product of claim 61 which has one or both sides clad with an aluminum composition different than said alloy.

63. The product of claim 61 which is sheet not over 0.25 inch thick.

64. The product of claim 61 which is light gauge plate not more than about 0.8 inch thick.

65. Improved skin member on a large jet aircraft, said skin member comprising an improved sheet or plate comprising an alloy consisting essentially of 0.6 to 1.6% Si, 0.6 to 1.6% Mg, 0.2 to 1.2% Cu and 0.2 to 0.9% Mn, balance essentially aluminum and incidental elements and impurities, said sheet or plate having improved fatigue crack growth rate in accordance with one or more of the maximum values in Table 4.

66. The improvement of claim 65 wherein the alloy contains 0.4 to 0.8% Mn.

67. The improved product of claim 66 which has one or both sides clad with an aluminum composition different than said alloy.

68. The product of claim 66 which is light gauge plate not more than about 0.8 inch thick.

69. The product of claim 66 which is sheet not over 0.25 inch thick.

70. The improved product of claim 65 which has one or both sides clad with an aluminum composition different than said alloy.

71. The product of claim 65 which is light gauge plate not over 0.8 inch thick.

72. The product of claim 65 which is sheet not over 0.25 inch thick.

73. Improved skin member on a large jet aircraft, said skin member comprising an improved sheet or plate product comprising an alloy consisting essentially of 0.6 to 1.2% Si, 0.8 to 1.2% Mg, 0.6 to 1.2% Cu; and either: (i) 0.2 to 0.8% Mn; or (ii) 0.5 to 0.9% Zn and 0.2 to 0.4% Cr; balance essentially aluminum and incidental elements and impurities, said sheet or plate having a maximum fatigue crack growth rate in accordance with one or more of the maximum values in Table 4.

74. The improved skin member of claim 73 which has one or both sides clad with an aluminum composition different than said alloy.

75. The improved skin member of claim 73 wherein said skin member is a fuselage belly member.

76. The improved skin member of claim 75 which has one or both sides clad with an aluminum composition different than said alloy.

77. The improved skin member of claim 73 wherein said skin member is a fuselage member.

78. The improved skin member of claim 77 which has one or both sides clad with an aluminum composition different than said alloy.

79. The improved skin member of claim 73 wherein said product is light gauge plate not more than about 0.8 inch thick.

80. The improved skin member of claim 73 wherein said product is sheet not over 0.25 inch thick.

81. An improved aircraft fuselage or fuselage portion comprising one or more fuselage skin shaped sheet or plate members comprising an alloy consisting essentially of 0.6 to 1% Si, 0.8 to 1.2% Mg, 0.6 to 1.1% Cu and 0.1 to 0.8% Mn, balance essentially aluminum and incidental elements and impurities, said sheet or plate having a maximum fatigue crack growth rate in accordance with one or more of the values in Table 4.

82. The improved fuselage or fuselage portion according to claim 81 wherein one or more of said sheet or plate members has one or both sides clad with an aluminum composition different than said alloy.

* * * * *